US011767578B2

(12) United States Patent
Yeh

(10) Patent No.: US 11,767,578 B2
(45) Date of Patent: Sep. 26, 2023

(54) HIGH STRENGTH AND WEAR RESISTANT MULTI-ELEMENT COPPER ALLOY AND ARTICLE COMPRISING THE SAME

(71) Applicant: National Tsing Hua University, Hsinchu (TW)

(72) Inventor: Jien-Wei Yeh, Hsinchu (TW)

(73) Assignee: NATIONAL TSING HUA UNIVERSITY, Hsinchu (TW)

( * ) Notice: Subject to any disclaimer, the term of this patent is extended or adjusted under 35 U.S.C. 154(b) by 82 days.

(21) Appl. No.: 17/356,707

(22) Filed: Jun. 24, 2021

(65) Prior Publication Data

US 2022/0380866 A1 Dec. 1, 2022

(30) Foreign Application Priority Data

May 26, 2021 (TW) ..... 110118948

(51) Int. Cl.
*C22C 9/06* (2006.01)
*C22C 1/02* (2006.01)

(52) U.S. Cl.
CPC . *C22C 9/06* (2013.01); *C22C 1/02* (2013.01)

(58) Field of Classification Search
CPC .... B21H 3/02; C22C 9/01; C22C 9/05; C22F 1/08; F16B 35/00
USPC ..... 420/471
See application file for complete search history.

(56) References Cited

U.S. PATENT DOCUMENTS

2001/0001641 A1 5/2001 Ninomiya et al.

FOREIGN PATENT DOCUMENTS

| | | |
|---|---|---|
| CN | 106065443 | 11/2016 |
| CN | 107779647 | 3/2018 |
| EP | 0939139 | 9/1999 |
| JP | 02-179839 | 7/1990 |
| JP | 07054079 A * | 2/1995 |
| JP | 2002-80924 | 3/2002 |
| JP | 2009-191337 | 8/2009 |
| JP | 2010-106363 | 5/2010 |
| KR | 10-2210703 | 2/2021 |

OTHER PUBLICATIONS

NPL: on-line translation of CN 107779647 A1, Mar. 2018 (Year: 2018).*
NPL: on-line translation of JP-07054079-A, Feb. 1995 (Year: 1995).*

(Continued)

*Primary Examiner* — Jie Yang

(57) ABSTRACT

A high strength and wear resistant multi-element copper alloy is disclosed. The multi-element copper alloy comprises: 80-90 atomic percent Cu, 0.1-4 atomic percent Al, 6-10 atomic percent Ni, 0.1-3 atomic percent Si, 0.1-2 atomic percent V and/or Nb, and 0.1-2 atomic percent M. Experimental data reveal that, after being applied with an aging treatment under 450 degrees Celsius for 50 hours, hardness and strength of the multi-element copper alloy are both significantly enhanced because of age hardening, and softening due to overaging is not observed on the multi-element copper alloy. Moreover, measurement data have indicated that, this novel multi-element copper alloy exhibits better wear resistance superior to that of the conventional copper alloys.

7 Claims, 2 Drawing Sheets

(56) References Cited

OTHER PUBLICATIONS

Search Report for Taiwan counterpart application TW110118948, dated Nov. 22, 2021.
(English translation) Search Report for Taiwan counterpart application TW110118948, dated Nov. 22, 2021.
Examination Report for Japan counterpart application JP2021-106216, dated Jul. 12, 2022.
(English translation) Examination Report for Japan counterpart application JP2021-106216, dated Jul. 12, 2022.
Search Report for EPO counterpart application EP21181354.8, dated Nov. 10, 2021.

* cited by examiner

HIGH STRENGTH AND WEAR RESISTANT MULTI-ELEMENT COPPER ALLOY AND ARTICLE COMPRISING THE SAME

BACKGROUND OF THE INVENTION

1. Field of the Invention

The present invention relates to the technology field of alloy materials, and more particularly to a high strength and wear resistant multi-element copper alloy and article comprising the same.

2. Description of the Prior Art

Copper and copper alloys have been widely applied in industrial manufacture and application because of their excellent characteristics of electrical conductivity, thermal conductivity, corrosion resistance, mechanical strength, and fatigue strength.

Material engineers skilled in design and manufacture of copper alloys certainly know that, copper-beryllium alloy and Corson alloy (i.e., Cu—Ni—Si alloy) are commonly adopted for the applications of high wear-resistant requirement, e.g., for the manufacture of bearing, precision gear, worm gear, bearing bushing, etc.

Nowadays, because machine tools are all demanded to perform increasingly higher machining accuracy and long-term stability, the wear resistance of the conventional copper-beryllium alloys and/or the conventional Cu—Ni—Si alloys are already unable to satisfy the market demand. FIG. 1 shows a curve graph of time versus hardness. As described in more detail below, the curves in FIG. 1 describe relationship between time and the hardness of various copper-beryllium alloys, where the hardness of each copper-beryllium alloy is measured at an environment temperature below 350 degrees Celsius. However, in despite of the fact that the conventional copper-beryllium alloys certainly exhibit excellent mechanical strength at the environment temperature below 350 degrees Celsius, related research data have indicated that the conventional copper-beryllium alloys still show a significant harness drop in case of the environment temperature being risen to be greater than 350 degrees Celsius. As a result, such phenomenon limits the high temperature applications of the conventional copper-beryllium alloys. On the other hand, it should be known that a temperature rise would occur at the interface between a copper-beryllium alloy and an article in case of there being an interfacial friction occurring between the copper-beryllium alloy and the article. From above descriptions, it is further known that, the copper-beryllium alloy may have an interface temperature greater than 600 degrees Celsius when being applied under high load and room temperature.

From above descriptions, it is understood that there is still room for improvement in the conventional copper alloys. In view of that, inventors of the present invention have made great efforts to make inventive research and eventually provided a high strength and wear resistant multi-element copper alloy and article comprising the same.

SUMMARY OF THE INVENTION

The primary objective of the present invention is to disclose a multi-element copper alloy with high strength and wear resistance, which comprises: 80-90 atomic percent Cu, 0.1-4 atomic percent Al, 6-10 atomic percent Ni, 0.1-3 atomic percent Si, 0.1-2 atomic percent V and/or Nb, and 0.1-2 atomic percent M. In which, M represents at least one additive element that is selected from a group consisting of Zr, Cr, Ti, Sn, Fe, Mn, Mg, C, P, and B. Experimental data reveal that, after being applied with an aging treatment under 450 degrees Celsius for 50 hours, hardness and strength of this novel multi-element copper alloy are both significantly enhanced because of age hardening, and softening due to overaging is not observed on the multi-element copper alloy. Moreover, measurement data have indicated that, this novel multi-element copper alloy exhibits better wear resistance superior to that of the conventional copper alloys. Therefore, the multi-element copper alloy according to the present invention has a significant potential for replacing the conventional copper alloy so as to be applied in the manufacture of a variety of parts and/or components, which are demanded to possess excellent wear resistance, such as bearing, gear, piston, connector, conductor rail, lead frames, relay, probe, etc.

For achieving the primary objective, the present invention discloses a first embodiment of the high strength and wear resistant multi-element copper alloy, which has a wear resistance greater than 415 m/mm$^3$, and has an elemental composition of $Cu_wAl_xNi_y Si_zN_mM_s$;

wherein w, x, y, z, m, and s are numeric values of Cu, Al, Ni, Si, N, and M in atomic percent, respectively;

wherein N represents at least one refractory element selected from a group consisting of Nb and V, and M represents at least one additive element selected from a group consisting of Zr, Cr, Ti, Sn, Fe, Mn, Mg, C, P, and B; and wherein w, x, y, z, m, and s satisfy $80 \le w \le 90$, $0.1 \le x \le 4$, $6 \le y \le 10$, $0.1 \le z \le 3$, $0.1 \le m \le 2$, and $0.1 \le s \le 2$.

In order to carry out the objective of the present invention, the present invention further discloses a second embodiment of the high strength and wear resistant multi-element copper alloy, which has a wear resistance greater than 475 m/mm$^3$, and has an elemental composition of $Cu_wAl_xNi_ySi_zN_mM_s$;

wherein w, x, y, z, m, and s are numeric values of Cu, Al, Ni, Si, N, and M in atomic percent, respectively;

wherein N represents at least one refractory element selected from a group consisting of Nb and V, and M represents at least one additive element selected from a group consisting of Zr, Cr, Ti, Sn, Fe, Mn, Mg, C, P, and B; and wherein w, x, y, z, m, ands satisfy $97 \le w \le 98.5$, $x \le 0.1$, $0.2 \le y \le 0.45$, $0.1 \le z \le 0.3$, $0.1 \le m \le 0.6$, and $0.1 \le s \le 1.6$.

In practicable embodiments, the high strength and wear resistant multi-element copper alloy is produced by using a manufacturing method selected from a group consisting of: vacuum arc melting process, electric resistance wire heating process, electric induction heating process, and rapid solidification process.

In practicable embodiments, the high strength and wear resistant multi-element copper alloy is further processed to be a semi-finished product or a product through a plastic deformation that is selected from a group consisting of casting process, forging process, extrusion process, and wire drawing process.

In practicable embodiments, the high strength and wear resistant multi-element copper alloy is further processed to a composite metal structure by being combined with at least one metal article.

In practicable embodiments, the high strength and wear resistant multi-element copper alloy is processed to be in an as-cast state or a homogenization state.

In practicable embodiments, the high strength and wear resistant multi-element copper alloy is in an age-hardened state after receiving a precipitation hardening treatment.

In addition, the present invention also discloses an article, which is made of the high strength and wear resistant multi-element copper alloy according to the present invention, e.g., precision gear, worm gear, and bearing bushing.

BRIEF DESCRIPTION OF THE DRAWINGS

The invention as well as a preferred mode of use and advantages thereof will be best understood by referring to the following detailed descriptions of an illustrative embodiment in conjunction with the accompanying drawings, wherein.

DETAILED DESCRIPTION OF THE PREFERRED EMBODIMENTS

Figure 1:
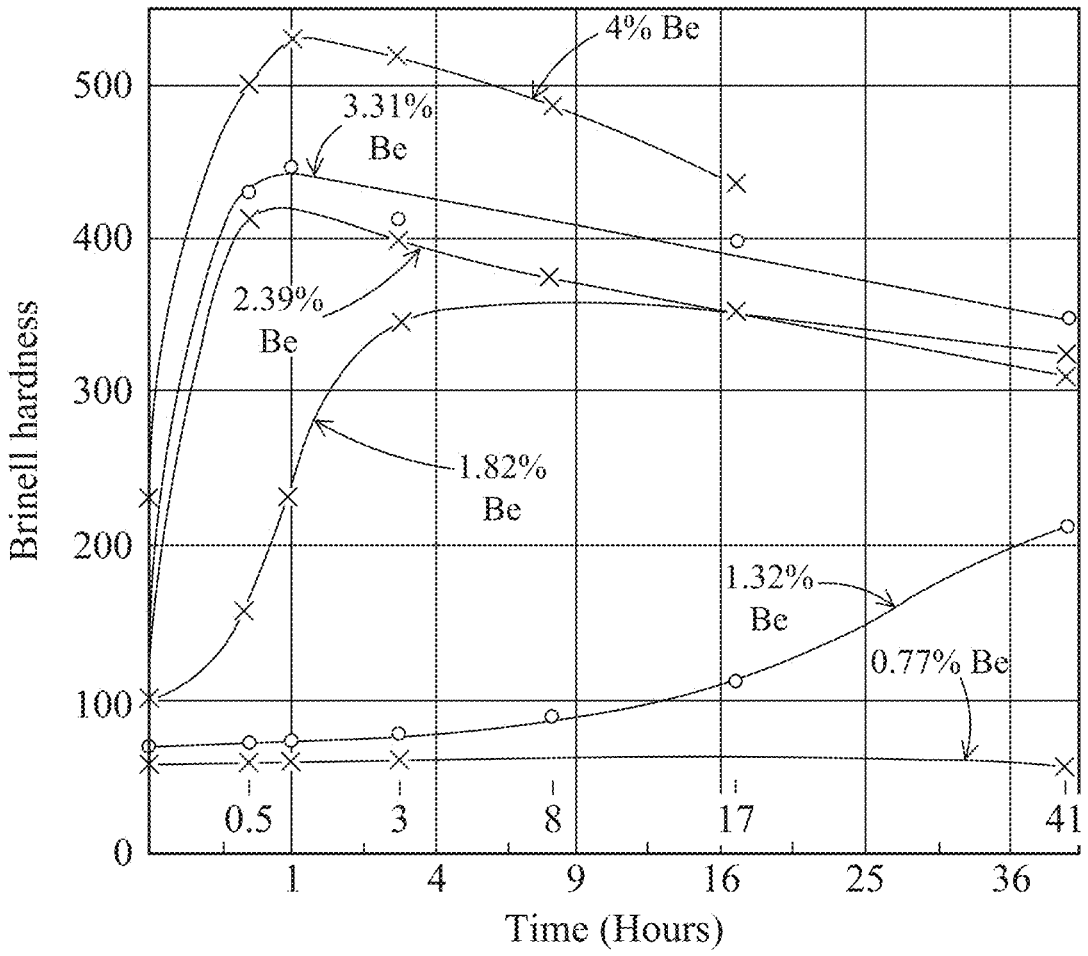
FIG. 1 shows a curve graph of time versus hardness.

To more clearly describe a high strength and wear resistant multi-element copper alloy and article comprising the same, embodiments of the present invention will be described in detail with reference to the attached drawings hereinafter.

First Embodiment

In the first embodiment, the high strength and wear resistant multi-element copper alloy is designed to have an elemental composition of $Cu_wAl_xNi_ySi_zN_mM_s$, so as to exhibit a specific property of wear resistance greater than 415 m/mm$^3$. In which, N represents at least one refractory element selected from a group consisting of Nb and V, and M represents at least one additive element selected from a group consisting of Zr, Cr, Ti, Sn, Fe, Mn, Mg, C, P, and B. As described in more detail below, w, x, y, z, m, and s are numeric values of Cu, Al, Ni, Si, N, and M in atomic percent, respectively. Moreover, w, x, y, z, m, and s satisfy $80 \le w \le 90$, $0.1 \le x \le 4$, $6 \le y \le 10$, $0.1 \le z \le 3$, $0.1 \le m \le 2$, and $0.1 \le s \le 2$. For example, the high strength and wear resistant multi-element copper alloy is designed to comprise: 82 at % Cu, 2 at % Al, 9 at % Ni, 3 at % Si, 1 at % V, 1 at % Nb, 1 at % Sn, and 1 at % Mn. In such case, the high strength and wear resistant multi-element copper alloy has an elemental composition of $Cu_{82}Al_2Ni_9Si_3V_1Nb_1Sn_1Mn_1$. That is, w=82, x=2, y=9, z=3, m=1+1=2, and s=1+1=2.

Second Embodiment

In the second embodiment, the high strength and wear resistant multi-element copper alloy is also designed to have an elemental composition of $Cu_wAl_xNi_ySi_zN_mM_s$, thereby exhibiting a specific property of wear resistance greater than 475 m/mm$^3$. In which, N represents at least one refractory element selected from a group consisting of Nb and V, and M represents at least one additive element selected from a group consisting of Zr, Cr, Ti, Sn, Fe, Mn, Mg, C, P, and B. As described in more detail below, w, x, y, z, m, and s are numeric values of Cu, Al, Ni, Si, N, and M in atomic percent, respectively. Moreover, w, x, y, z, m, and s satisfy $97 \le w \le 98.5$, $x \le 0.1$, $0.2 \le y \le 0.45$, $0.1 \le z \le 0.3$, $0.1 \le m \le 0.6$, and $0.1 \le s \le 1.6$. For instance, the high strength and wear resistant multi-element copper alloy is designed to comprise: 97 at % Cu, 0.1 at % Al, 0.45 at % Ni, 0.25 at % Si, 0.3 at % V, 0.3 at % Nb, 0.45 at % Zr, 0.45 at % Cr, 0.45 at % Ti, and 0.25 at % C. In such case, the high strength and wear resistant multi-element copper alloy has an elemental composition of $Cu_{97}Al_{0.1}Ni_{0.45}Si_{0.25}V_{0.3}Nb_{0.3}Zr_{0.45}Cr_{0.45}Ti_{0.45}C_{0.25}$. That is, w=97, x=0.1, y=0.45, z=0.25, m=0.3+0.3=0.6, and s=0.45+0.45+0.45+0.25=1.6.

The high strength and wear resistant multi-element copper alloy according to the present invention can be produced by using a specific manufacturing method, such as vacuum arc melting process, electric resistance wire heating process, electric induction heating process, or rapid solidification process. Moreover, according to different applications, material engineers are able to process the high strength and wear resistant multi-element copper alloy of the present invention to a semi-finished product or a product through a plastic deformation, e.g., casting process, forging process, extrusion process, or wire drawing process. Furthermore, according to different applications, the high strength and wear resistant multi-element copper alloy can also be processed to a composite metal structure by being combined with at least one metal article.

In a nutshell, the present invention discloses a high strength and wear resistant multi-element copper alloy having excellent wear resistance. The high strength and wear resistant multi-element copper alloy has a significant potential for replacing the conventional copper alloys so as to be applied in the manufacture of a variety of parts and/or components, which are demanded to possess excellent wear resistance, such as bearing, gear, piston, connector, conductor rail, lead frames, relay, probe, etc. Notably, for proving that the forgoing two embodiments of the high strength and wear resistant multi-element copper alloy of the present invention can indeed be made, inventors of the present invention have conducted a number of experiments.

First Experiment

In the first experiment, 12 samples of the high strength and wear resistant multi-element copper alloy according to the present invention are fabricated by vacuum arc melting process. The following table (1) lists each sample's elemental composition. Moreover, homogenization process, precipitation hardening process, hardness measurement, and dry sliding wear test for the 12 samples are also completed. It is worth explaining that, the high strength and wear resistant multi-element copper alloy in an as-cast state can be further homogenized to, so as to be a homogenization state. Homogenization mitigates the effects of dendritic segregation during solidification and generates a more uniform chemical composition within the alloy, thereby enhancing the precipitation hardening effect during the age hardening treatment of the high strength and wear resistant multi-element copper alloy.

The dry sliding wear test is carried out by operating a pin-on-disk test machine. The disk is made from SKD-61, and 12 test specimens, having dimensions of 8 mm in diameter and 3 mm in thickness, are cut from 12 samples of the high strength and wear resistant multi-element copper alloy, respectively. When conducting the dry sliding wear test, the test specimen is held pressed against a rotating SKD-61 disk by applying load that acts as counter weight and balances the test specimen. The wear resistance of each sample can be calculated by using formula Wsp=D/V, where D and V are total wear distance and the total wear volume, respectively.

In the first experiment, all samples are applied with a homogenization process at 900 degrees Celsius for 6 hours, and are subsequently applied with an age hardening process at 450 degrees Celsius for 50 hours. Therefore, related measurement data of the 12 samples are recorded in the following table (1).

TABLE (1)

| high strength and wear resistant multi-element copper alloy | | Hardness (HV) | | |
|---|---|---|---|---|
| Samples | Elemental composition | homogenization state | age-hardened state | wear resistance ($m/mm^3$) |
| No. 1 | $Cu_{82}Al_4Ni_{10}Si_3V_1$ | 132 | 282 | 423 |
| No. 2 | $Cu_{82}Al_4Ni_{10}Si_3Nb_1$ | 135 | 284 | 430 |
| No. 3 | $Cu_{82}Al_3Ni_9Si_{2.5}V_1Nb_{0.5}Cr_1Fe_{0.5}P_{0.5}$ | 102 | 295 | 457 |
| No. 4 | $Cu_{82}Al_2Ni_9Si_3V_1Nb_1Sn_1Mn_1$ | 119 | 285 | 477 |
| No. 5 | $Cu_{82}Al_3Ni_8Si_3V_1Nb_1Zr_{0.5}Ti_1Mn_{0.5}$ | 108 | 301 | 490 |
| No. 6 | $Cu_{82}Al_3Ni_8Si_3V_1Nb_1Cr_1Mg_{0.5}C_{0.5}$ | 185 | 292 | 531 |
| No. 7 | $Cu_{88}Al_{1.5}Ni_{7.5}Si_1Nb_1Zr_{0.5}P_{0.5}$ | 104 | 277 | 462 |
| No. 8 | $Cu_{88}Al_1Ni_8Si_1V_1Ti_{0.5}Mg_{0.3}B_{0.2}$ | 149 | 281 | 483 |
| No. 9 | $Cu_{88}Al_1Ni_{8.5}Si_1Nb_{0.5}Cr_{0.5}Ti_{0.3}Fe_{0.2}$ | 113 | 284 | 433 |
| No. 10 | $Cu_{88}Al_1Ni_{7.5}Si_2V_{0.5}Zr_{0.5}Mn_{0.5}$ | 131 | 272 | 421 |
| No. 11 | $Cu_{88}Al_{1.5}Ni_{7.5}Si_1V_{0.5}Nb_{0.3}Zr_1Sn_{0.2}$ | 124 | 279 | 418 |
| No. 12 | $Cu_{88}Al_{1.5}Ni_{7.5}Si_1V_1Cr_{0.5}Fe_{0.2}C_{0.3}$ | 157 | 287 | 513 |

As described in more detail below, the table (1) has listed each sample's elemental composition. According to the measurement data recorded in the table (1), it is found that, the alloy wear resistance can indeed be enhanced by making the multi-element copper alloy (CuAlNiSi) further contain at least one additive element (i.e., Zr, Cr, Ti, Sn, Fe, Mn, Mg, C, P, and/or B) with minor addition and at least one refractory element like Nb and/or V. Most important of all, the measurement data recorded in the table (1) have proved that, the high strength and wear resistant multi-element copper alloy of the present invention exhibits outstanding wear resistance superior to that of the conventional C17200 copper-beryllium alloy (390 $m/mm^3$) Therefore, the high strength and wear resistant multi-element copper alloy according to the present invention has a significant potential for replacing the conventional copper alloy so as to be applied in the manufacture of a variety of parts and/or components, which are demanded to possess excellent wear resistance, such as bearing, gear, piston, connector, conductor rail, lead frames, relay, probe, etc.

aging treatment under 450 degrees Celsius for 50 hours, and there is no softening due to over-aging occurring on the sample No. 3 even if the aging time is prolonged to 100 hours. As a result, experimental data have proved that, the high strength and wear resistant multi-element copper alloy still exhibits excellent mechanical strength at a high environment temperature, and such important characteristic is found to be a key factor for enhancing the wear resistance of the high strength and wear resistant multi-element copper alloy of the present invention.

It is worth explaining that, making the multi-element copper alloy (CuAlNiSi) further contain at least one additive element (i.e., Zr, Cr, Ti, Sn, Fe, Mn, Mg, C, P, and/or B) with minor addition and at least one refractory element like Nb and/or V induces competition between elements in the multi-element copper alloy, thereby reducing solid-state diffusion rate of the elements in the alloy. As a result, rate of crystal nucleation in the alloy is reduced, such that the grain of each of the precipitations produced in the alloy grows smaller, thereby enhancing alloy hardness and preventing the alloy from softening due to overaging. For example, because V and Nb are both refractory elements with high melting point, they exhibit low solid-state diffusion rate in a Cu-based principal phase of the multi-element copper alloy. Moreover, there is a strong bonding energy between Si and V or Nb, that makes V—Si and/or Nb—Si compound be precipitated in the alloy as well as slows the formation rate of Ni—Si—V—Nb compound. In conclusion, making the multi-element copper alloy (CuAlNiSi) further contain at least one additive element (i.e., Zr, Cr, Ti, Sn, Fe, Mn, Mg, C, P, and/or B) with minor addition and at least one refractory element like Nb and/or V is helpful in enhancing the wear resistance of the alloy.

Second Experiment

In the second experiment, 8 samples of the high strength and wear resistant multi-element copper alloy according to the present invention are also fabricated by vacuum arc melting process. The following table (2) lists each sample's elemental composition. Moreover, homogenization process, precipitation hardening process, hardness measurement, and dry sliding wear test for the 8 samples are also completed. Therefore, related measurement data of the 8 samples are recorded in the following table (2).

TABLE (3)

| high strength and wear resistant multi-element copper alloy | | Hardness (HV) | | |
|---|---|---|---|---|
| Samples | Elemental composition | homogenization state | age-hardened state | wear resistance ($m/mm^3$) |
| No. 13 | $Cu_{97}Al_{0.1}Ni_{0.45}Si_{0.25}V_{0.3}Nb_{0.3}Zr_{0.45}Cr_{0.45}Ti_{0.45}C_{0.25}$ | 92 | 155 | 510 |
| No. 14 | $Cu_{97.3}Al_{0.1}Ni_{0.45}Si_{0.3}V_{0.3}Nb_{0.2}Cr_{0.45}Fe_{0.45}Mg_{0.3}B_{0.15}$ | 87 | 149 | 488 |
| No. 15 | $Cu_{97.3}Al_{0.1}Ni_{0.35}Si_{0.3}V_{0.45}Zr_{0.45}Ti_{0.45}Mn_{0.45}P_{0.15}$ | 89 | 152 | 503 |
| No. 16 | $Cu_{97.75}Al_{0.1}Ni_{0.45}Si_{0.2}V_{0.25}Nb_{0.15}Cr_{0.45}Sn_{0.2}Fe_{0.3}C_{0.15}$ | 58 | 142 | 479 |
| No. 17 | $Cu_{98}Ni_{0.35}Si_{0.2}V_{0.3}Nb_{0.2}Zr_{0.15}Cr_{0.45}Ti_{0.2}C_{0.15}$ | 76 | 134 | 697 |
| No. 18 | $Cu_{98}Al_{0.1}Ni_{0.45}Si_{0.3}Nb_{0.25}Cr_{0.3}Sn_{0.3}Mg_{0.15}P_{0.15}$ | 51 | 135 | 527 |
| No. 19 | $Cu_{98.15}Ni_{0.4}Si_{0.2}V_{0.15}Zr_{0.3}Cr_{0.45}Mn_{0.2}C_{0.15}$ | 55 | 139 | 586 |
| No. 20 | $Cu_{98.5}Ni_{0.25}Si_{0.1}V_{0.25}Nb_{0.15}Zr_{0.3}Ti_{0.3}C_{0.15}$ | 51 | 130 | 566 |

Figure 2:
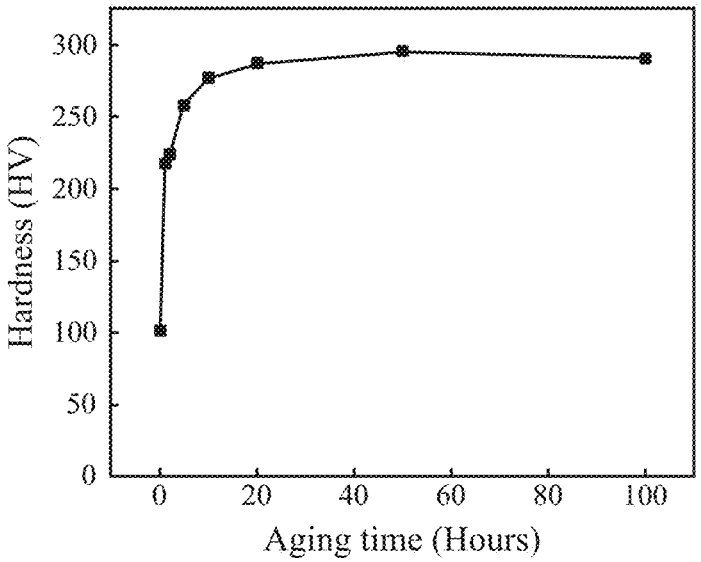
FIG. 2 shows a curve graph of aging time versus hardness.
Figure 3:
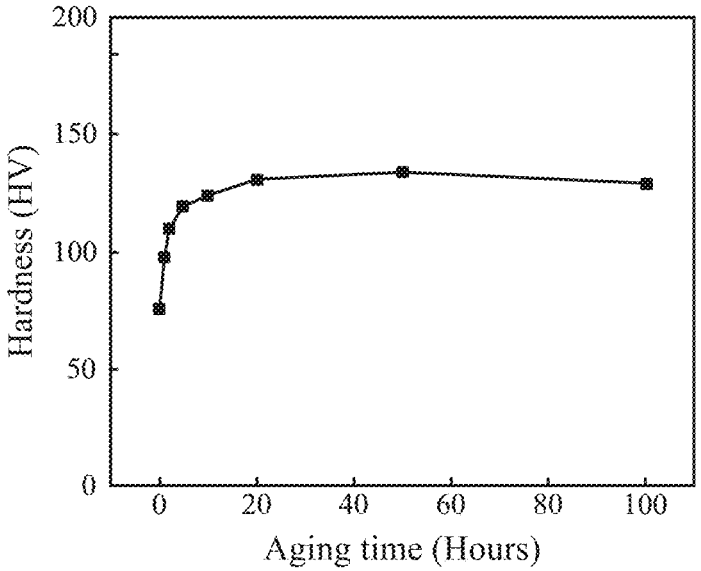
FIG. 3 shows a curve graph of aging time versus hardness.

FIG. 2 shows a curve graph of aging time versus hardness of sample No. 3 of the high strength and wear resistant multi-element copper alloy. As explained in more detail below, sample No. 3 of the high strength and wear resistant multi-element copper alloy is regularly applied with an As described in more detail below, the table (2) has listed each sample's elemental composition. Moreover, FIG. 3 shows a curve graph of aging time versus hardness of sample No. 17 of the high strength and wear resistant multi-element copper alloy. As explained in more detail below, sample No.

17 of the high strength and wear resistant multi-element copper alloy is regularly applied with an aging treatment under 450 degrees Celsius for 50 hours, and there is no softening due to over-aging occurring on the sample No. 17 even if the aging time is prolonged to 100 hours. As a result, experimental data have proved that, the high strength and wear resistant multi-element copper alloy still exhibits excellent mechanical strength at a high environment temperature, and such important characteristic is found to be a key factor for enhancing the wear resistance of the high strength and wear resistant multi-element copper alloy of the present invention.

According to the measurement data recorded in the table (2), it is found that, making the multi-element copper alloy (CuAlNiSi) further contain at least one additive element (i.e., Zr, Cr, Ti, Sn, Fe, Mn, Mg, C, P, and/or B) with minor addition and at least one refractory element like Nb and/or V induces competition between elements in the multi-element copper alloy, thereby reducing solid-state diffusion rate of the elements in the alloy. As a result, rate of crystal nucleation in the alloy is reduced, such that the grain of each of the precipitations produced in the alloy grows smaller, thereby enhancing alloy hardness and preventing the alloy from softening due to overaging. Most important of all, the measurement data recorded in the table (2) have proved that, the high strength and wear resistant multi-element copper alloy of the present invention exhibits outstanding wear resistance superior to that of the conventional C17200 copper-beryllium alloy (390 m/mm$^3$) Therefore, the high strength and wear resistant multi-element copper alloy according to the present invention has a significant potential for replacing the conventional copper alloy so as to be applied in the manufacture of a variety of parts and/or components, which are demanded to possess excellent wear resistance, such as bearing, gear, piston, connector, conductor rail, lead frames, relay, probe, etc.

Therefore, through above descriptions, all embodiments and their experimental data of the high strength and wear resistant multi-element copper alloy according to the present invention have been introduced completely and clearly; in summary, the present invention includes the advantages of:

(1) The present invention discloses a multi-element copper alloy with high strength and wear resistance, which comprises: 80-90 atomic percent Cu, 0.1-4 atomic percent Al, 6-10 atomic percent Ni, 0.1-3 atomic percent Si, 0.1-2 atomic percent V and/or Nb, and 0.1-2 atomic percent M. In which, M represents at least one additive element that is selected from a group consisting of Zr, Cr, Ti, Sn, Fe, Mn, Mg, C, P, and B. Experimental data reveal that, after being applied with an aging treatment under 450 degrees Celsius for 50 hours, hardness and strength of this novel multi-element copper alloy are both significantly enhanced because of age hardening, and softening due to overaging is not observed on the multi-element copper alloy. Moreover, measurement data have indicated that, this novel multi-element copper alloy exhibits better wear resistance superior to that of the conventional copper alloys. Therefore, the multi-element copper alloy according to the present invention has a significant potential for replacing the conventional copper alloy so as to be applied in the manufacture of a variety of parts and/or components, which are demanded to possess excellent wear resistance, such as bearing, gear, piston, connector, conductor rail, lead frames, relay, probe, etc.

The above descriptions are made on embodiments of the present invention. However, the embodiments are not intended to limit the scope of the present invention, and all equivalent implementations or alterations within the spirit of the present invention still fall within the scope of the present invention.

What is claimed is:

1. A multi-element copper alloy consisting of:

82 to 90 atomic percent Cu;

0.1 to 3.5 atomic percent Al;

6 to 10 atomic percent Ni;

0.1 to 3 atomic percent Si;

0.1 to 2 atomic percent N; and 0.1 to 2 atomic percent M;

wherein N comprises at least one refractory element selected from a group consisting of Nb and V, and M comprises at least one additive element selected from a group consisting of Zr, Cr, Ti, Sn, Fe, Mn, Mg, C, P, and B;

wherein the multi-element copper alloy shows a wear resistance greater than 415 m/mm$^3$ and a hardness of at least HV272 after being subjected to a homogenization treatment under 900° C. for 6 hours and an age hardening under 450° C. for 50 hours.

2. The multi-element copper alloy of claim 1, being produced by using a manufacturing method selected from a group consisting of: vacuum arc melting process, electric resistance wire heating process, electric induction heating process, and rapid solidification process.

3. The multi-element copper alloy of claim 1, being further processed to be a semi-finished product or a product through a plastic deformation that is selected from a group consisting of casting process, forging process, extrusion process, and wire drawing process.

4. The multi-element copper alloy of claim 1, being further processed to a composite metal structure by being combined with at least one metal article.

5. The multi-element copper alloy of claim 1, being processed to be in an as-cast state or a homogenization state.

6. The multi-element copper alloy of claim 1, wherein the high strength and wear resistant multi-element copper alloy is in an age-hardened state after receiving a precipitation hardening treatment.

7. The multi-element copper alloy of claim 1, wherein said high strength and wear resistant multi-element copper alloy is further processed to an article that is selected from a group consisting of bearing, gear, piston, connector, conductor rail, lead frames, relay, and probe.

* * * * *